United States Patent [19]

Forristall et al.

[11] 4,095,671

[45] Jun. 20, 1978

[54] ADJUSTABLE SELF-LOCKING LEVEL SUPPORT

[75] Inventors: David E. Forristall, Suisun; Allen C. Wright, Moraga, both of Calif.

[73] Assignee: Utility Products, Inc., Oakland, Calif.

[21] Appl. No.: 438,735

[22] Filed: Feb. 1, 1974

[51] Int. Cl.[2] ..... E06C 7/44

[52] U.S. Cl. ..... 182/202

[58] Field of Search ..... 182/202, 200, 201, 203; 248/172, 173, 188.5, 149, 164, 287, 188.2, 188.3

[56] References Cited

U.S. PATENT DOCUMENTS

| | | | |
|---|---|---|---|
| 1,475,437 | 11/1923 | Klocke | 267/178 |
| 2,548,311 | 4/1951 | Johnson | 182/202 |
| 2,835,427 | 5/1958 | Balcar | 182/202 |
| 2,894,670 | 7/1959 | Anderson | 182/202 |
| 2,969,126 | 1/1961 | Gardner | 182/202 |
| 3,102,606 | 9/1963 | Hopfeld | 182/202 |
| 3,215,383 | 11/1965 | Wright | 248/188.3 |

*Primary Examiner*—Reinaldo P. Machado

[57] ABSTRACT

The invention relates to a self-locking level support primarily for ladders and the like, the support being adjustable to fit ladders of different widths.

4 Claims, 6 Drawing Figures

ADJUSTABLE SELF-LOCKING LEVEL SUPPORT

Our invention relates primarily to ladders and more particularly to ladder level supports.

A ladder level support is a device capable of supporting a ladder in a stable position on a sloping or otherwise uneven supporting surface.

The present invention is an improvement upon the self leveling support of U.S. Pat. No. 3,215,383 of Nov. 2, 1965 in which the inventor is a co-inventor of the improvement forming the subject matter of the present application.

In the device of the aforementioned patent, a U-shaped tubular housing houses a normally open clutch or self-locking mechanism in each leg thereof, with each such clutch mechanism being coupled to a leg extension protruding from the proximate leg of the housing and terminating in a swivel mounted foot. Internally of the housing, the space between the clutch mechanisms is occupied by a power transfer assembly.

By installing the device between the lower ends of the side rails of a ladder, the leg extensions engage the supporting surface to support the ladder.

As long as the power transfer assembly and associated clutch mechanisms are free to slide within the tubular housing, the clutch mechanisms maintain their normally open condition. However, when such movement meets resistance both clutch mechanisms will lock automatically.

Thus, when a ladder with the device installed is raised to a position normal to the horizontal, to engage a supporting surface, the internal components within the housing will slide in response to initial contact with the supporting surface until both leg extensions solidly engage the supporting surface, whereupon resistance develops against further sliding and the clutch mechanisms will automatically lock in response to weight of the ladder or weight placed thereon, and the device under these conditions will stably support the ladder in its normal-to-the horizontal position, despite the character of the supporting surface, that is, whether it is level or sloping.

Aside from the fact that the power transfer assembly of the patented device is complex because of the necessity for it to freely turn corners of the housing, the device of the aforementioned patent, suffers another limitation namely that it had to be fabricated to dimensions which enable it to satisfy the requirements of a particular ladder.

Among the objects of our invention are;

(1) To provide a novel and improved self-locking level support for a ladder or the like;

(2) To provide a novel and improved self-locking level support for a ladder or the like, which is of simple design and capable of being fabricated economically;

(3) To provide a novel and improved self-locking level support for a ladder or the like wherein a single device can be fabricated to meet the requirements of ladders within a substantial range of widths.

(4) To provide a novel and improved self-locking level support for a ladder or the like which can be readily adjustable to satisfy the requirements of ladders of different widths.

Additional objects of our invention will be brought out in the following description of a preferred embodiment of the same, taken in conjunction with the accompanying drawings wherein FIG. 1 is a view in elevation of a self-locking level support embodying the present invention;

Figures 1, 6:
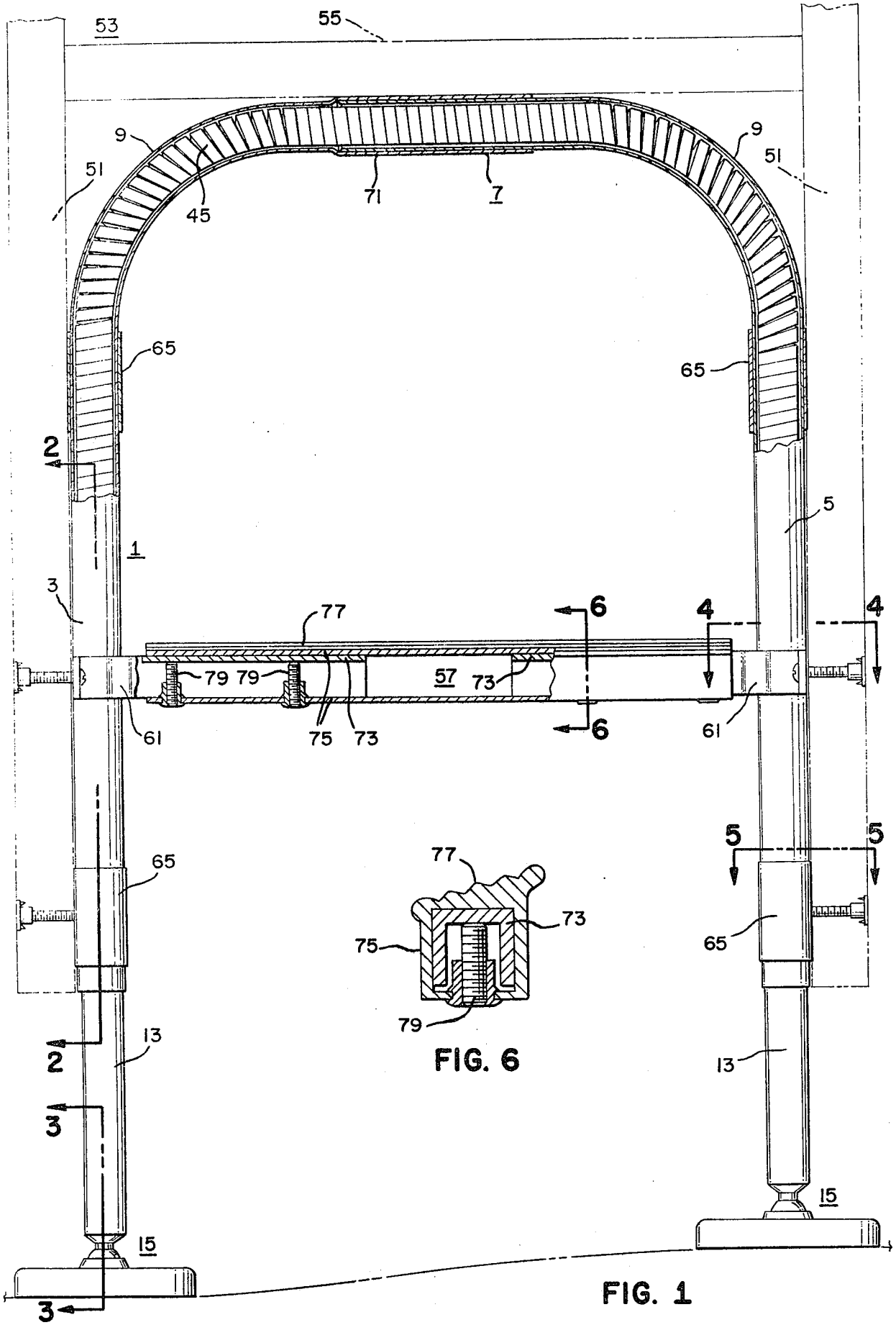
FIG. 6 is a view in section taken in the plane 6—6 of FIG. 1.
Figure 2:
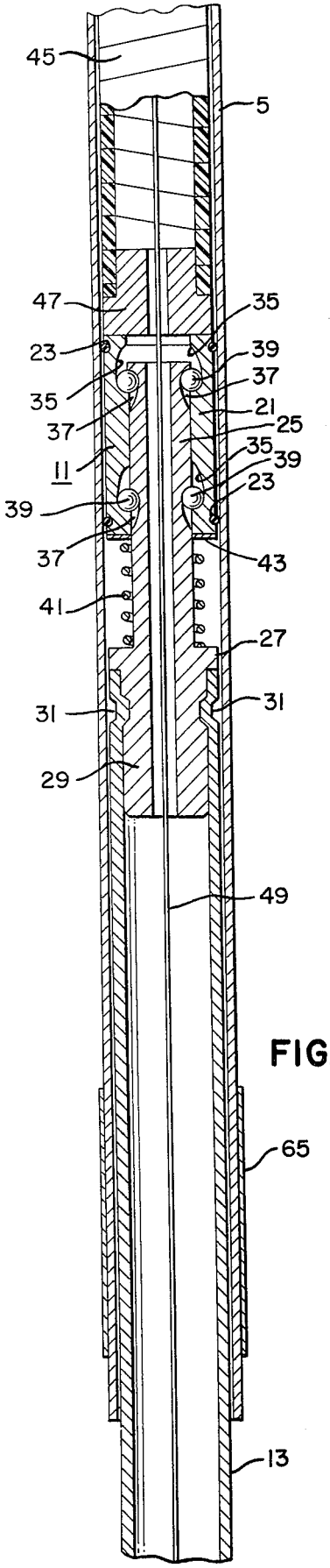
FIG. 2 is a view in section, taken in the plane 2—2 of FIG. 1.
Figure 4:
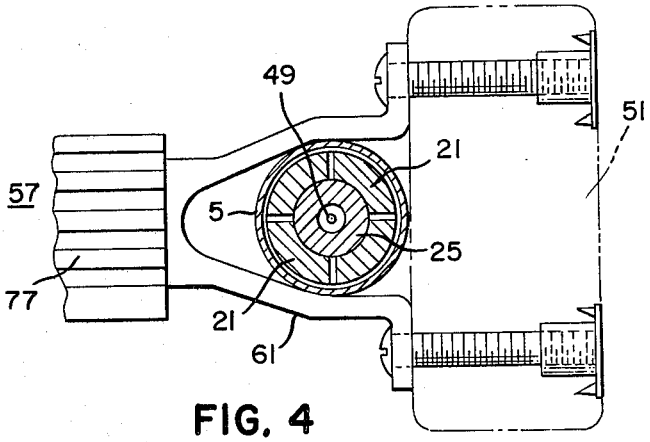
FIG. 4 is a view in section, taken in the plane 4—4 of FIG. 1.
Figure 5:
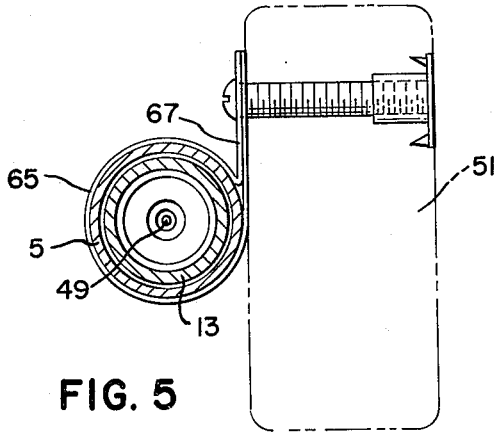
FIG. 5 is a view in section, taken in the plane 5—5 of FIG. 1.
Figure 3:
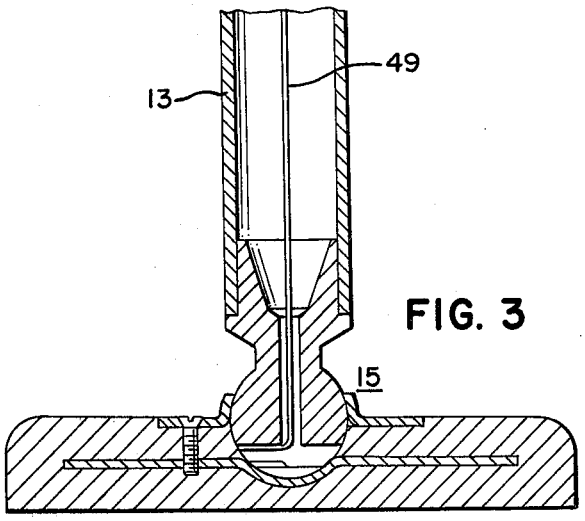
FIG. 3 is a view in section taken in the plane 3—3 of FIG. 1.

For details of our invention in its preferred form, reference will be had to the accompanying drawings wherein the device involves a tubular housing 1 of U-shape having substantially parallel legs 3, 5 coupled by a bridge 7 joining each leg in arcuate bend 9.

In each leg is a normally open but pressure responsive self-locking assembly 11, each, at one end, being coupled to a tubular leg extension 13 protruding from the proximate leg of the housing and terminating in a swivel mounted surface engagable foot assembly 15.

Each pressure responsive self-locking assembly may be of any suitable type though, preferably, basically similar to that of the aforementioned patent, with certain modifications in the interest of simplicity.

Each such assembly accordingly, involves a pair of telescoping components, one as a hollow cylinder formed of longitudinal segments 21 held together by spaced apart encircling O-rings 23, with the other component 25 slidably fitting or telescoping the first component and terminating below in spaced relationship thereto, in a flange 27 followed by a coupling extension 29 frictionally fitting into the proximate leg extension 13 and more solidly anchored thereto by indenting the engaged leg portion in the coupling extension at a plurality of peripherally spaced points 31.

At corresponding locations in the opposing surfaces of the telescoping portions of the two components, the components are recessed, the recesses 35 in the segments forming the outer cylindrical component 21 being tapered upwardly, while those 37 in the inner component are tapered downwardly, with a ball 39 loosely occupying each pair of opposing recesses at their deepest points, representing the open condition of the self-locking assembly, which condition is normally encouraged by a compression spring 41 installed under compression between the lower end of the hollow cylindrical component and the flange on the inner component. A washer 43 between the lower end of the cylindrical component and the spring, will serve to maintain symmetry among the segments and thereby assure proper functioning of the self-locking mechanism.

Unique to the present invention is the pressure transfer means employed, which takes the form of a flexible coil 45 freely slidable in the housing and formed of close contacting turns of ribbon material of substantially rectangular cross-section and of sufficient thickness to preclude overlapping of turns when said coil is exposed to longitudinal pressure.

At each end, this coil is fitted with a plug 27 and is of an overall length to freely flex about the arcuate corners 9 of the housing and engage the proximate ends of the self-locking assemblies, to which it is held in contact by an axial wire or cable 49 threaded through the housed components and anchored under tension at each end to one of the foot assemblies.

The device is adapted for installation between the lower ends of the side rails 51 of a ladder 53 and to assure rigidity of such installation, the device is preferably fabricated to a height sufficient to rest against the underside of the second rung 55 of the ladder, when installed. This necessitates, therefore, removal of the first rung of the ladder, and to compensate therefore, a substitute rung assembly 57 is provided as part of the overall device assembly and capable of attachment to side rails of the ladder, as part of the installation.

Structurally, such substitute rung assembly for purposes of installation, may be provided at each end with a flanged fork or yoke 61 adapted to straddle the proximate leg of the housing and engage the proximate side rail of the ladder to which it may be bolted. Such manner of bolting the rung assembly to the side rails, serves to pressure clamp the adjacent leg of the housing to the side rail at the same time.

At a location on the leg of the housing, above and below the yoke, the leg is encircled by a sleeve clamp 65 formed longitudinally with a flange 67 through which, it may be bolted to the inner side of the adjacent rail of the ladder to stabilize installation of the device.

An important feature of the present invention is the adjustability built into the device which enables it to be adjusted to satisfy the installation requirements with respect to ladders of different widths between side rails. With this in mind, the housing 1 is formed of two tubular sections, each including a leg 3 or 5 and a portion of the bridge, with the upper end 71 of one of the sections, enlarged to permit telescoping of the approaching ends of both sections to form the bridge. The telescoping portions should be of sufficient length to enable adjustment of the bridge length within the range of ladder widths contemplated and the overall length of the housed components including the pressure transfer coil, the self-locking mechanisms and the leg extensions, must be designed with the maximum contemplated adjustment in mind, thus to enable the device in its maximum adjusted condition, to accommodate itself to supporting surfaces of maximum out-of-level character.

To render the substitute rung correspondingly adjustable, the yokes 61 are each fabricated independently with a shank 73 of preferably channel section extending part way across the distance between the two legs of the housing and slidably fitting into the proximate end of a hollow extrusion 75 of box section, with the upper surface sloping and ribbed longitudinally to form a thread 77.

This rung assembly is thus adjustable as to length to match the width within the range of adjustment of the housing 1. In any adjusted position of the rung assembly, the adjustment may be fixed by provision of a plurality of locking screws 79 in the underside of the box section and facing the shanks of the mounting yokes, against which the screws may be tightened to lock and rigidify the rung assembly.

Regardless of any adjustment of the device, the housed components are free to slide in the housing, so long as both feet are not in engagement with a supporting surface. Accordingly, with but one foot in engagement with such surface, the weight of the ladder will cause it to drop until the resulting shift of the housed components brings the remaining foot into engagement with the supporting surface.

At this stage, no further shifting can occur, and with sufficient weight upon the housing to compress the springs 41, the segments 21 will spread slightly to compress the O-rings against the housing wall, and the inner component will become locked to the segments forming the outer cylinder. By correlating the calibration of the springs to the weight of a ladder, the mere weight of the ladder can effect such locking. Otherwise the individual would have to add his own weight.

Upon removal of the ladder, the springs 41 will automatically release the self-locking mechanisms.

From the foregoing description of our invention in its preferred form, it will be apparent that the same is subject to alteration and modification without departing from the underlying principles involved, and we accordingly, do not desire to be limited in our protection to the specific details illustrated and described, except as may be necessitated by the prior art.

We claim:

1. A self-locking level support applicable to ladders or the like of different widths comprising a two part U-shape housing with one part slidably overlapping the other to form an adjustable bridge between the two legs of said housing, a pressure responsive self-locking assembly in each leg of said housing, each said self-locking assembly including means, in the absence of pressure on said assembly, for establishing and maintaining an unlocked condition thereof, a leg extension extending from a leg of said U-shape housing in slidable relationship therewith and in pressure transfer relationship with the proximate pressure responsive self-locking assembly, a similar leg extension likewise extending from the other leg of said U-shape housing in slidable relationship and in pressure transfer relationship with the proximate pressure responsive self-locking assembly, and pressure transfer means installed between said pressure responsive self-locking assemblies and in pressure transfer relationship therewith.

2. A self-locking level support in accordance with claim 1, characterized by said two part housing being formed of tubing sections with said sections telescoping to form said bridge of adjustable length, and said pressure responsive self-locking assemblies, said leg extensions and said pressure transfer means being slidably installed in said housing.

3. A self-locking level support in accordance with claim 1, characterized by a length adjustable rung supportable between said legs.

4. A self-locking level support in accordance with claim 3, characterized by said length adjustable rung including a yoke at each end adapted to straddle the proximate leg of said U-shape housing, and means for affixing said adjustable rung via said yokes to the side rails of a ladder.

* * * * *